US006784997B2

(12) United States Patent
Lorenz et al.

(10) Patent No.: US 6,784,997 B2
(45) Date of Patent: Aug. 31, 2004

(54) DEVICE FOR DETERMINING TYPE AND DAMPNESS OF TEXTILES, APPLIANCES APPLYING THE DEVICE, METHOD FOR DETECTING TYPE AND DAMPNESS OF TEXTILES, AND METHOD FOR DETERMINING A FILLING LEVEL OF A CONTAINER

(75) Inventors: Tilmann Lorenz, Regensburg (DE); Willibald Reitmeier, Hemau (DE); Walter Sams, Lappersdorf (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 64 days.

(21) Appl. No.: 10/177,681

(22) Filed: Jun. 20, 2002

(65) Prior Publication Data

US 2003/0019253 A1 Jan. 30, 2003

Related U.S. Application Data

(63) Continuation of application No. PCT/EP00/12228, filed on Dec. 5, 2000.

(30) Foreign Application Priority Data

Dec. 20, 1999 (DE) ..... 199 61 459

(51) Int. Cl.[7] ..... G01N 21/84

(52) U.S. Cl. ..... 356/429; 356/432; 356/445; 68/12.05

(58) Field of Search ..... 356/429, 432, 356/445; 68/12.05

(56) References Cited

U.S. PATENT DOCUMENTS 5,230,228 A 7/1993 Nakano et al.
5,739,534 A * 4/1998 Estenson et al. ..... 250/339.11

FOREIGN PATENT DOCUMENTS

| | | |
|---|---|---|
| DE | 35 41 810 A1 | 6/1987 |
| DE | 37 06 056 A1 | 5/1988 |
| DE | 38 12 089 A1 | 10/1989 |
| EP | 0 612 996 A2 | 8/1994 |

* cited by examiner

*Primary Examiner*—Frank G. Font
*Assistant Examiner*—Roy M. Punnoose
(74) *Attorney, Agent, or Firm*—Laurence A. Greenberg; Werner H. Stemer; Gregory L. Mayback

(57) ABSTRACT

A device detects properties of a textile in appliances for treating textiles is provided. The device is fitted into the appliance. Examples of appliances with which the device can be used include washing machines, laundry dryers, spin dryers, machines for dry cleaning, and machines for dying textiles. The device includes sending element and a receiving element respectively for sending and receiving electromagnetic radiation. The receiving element is connected to an evaluation circuit. The evaluation circuit evaluates the radiation reflected and/or transmitted by the textile to render properties and composition of the textile and filling level of the appliance.

68 Claims, 6 Drawing Sheets

DEVICE FOR DETERMINING TYPE AND DAMPNESS OF TEXTILES, APPLIANCES APPLYING THE DEVICE, METHOD FOR DETECTING TYPE AND DAMPNESS OF TEXTILES, AND METHOD FOR DETERMINING A FILLING LEVEL OF A CONTAINER

CROSS-REFERENCE TO RELATED APPLICATION

This application is a continuation of copending International Application No. PCT/EP00/12228, filed Dec. 5, 2000, which designated the United States and was not published in English.

BACKGROUND OF THE INVENTION

Field of the Invention

The invention relates to devices for determining type and dampness of textiles, appliances utilizing such devices, methods for detecting type and dampness of textiles, and methods for determining a filling level of a container. The device includes at least one sending element and one receiving element for sending and receiving electromagnetic radiation and also an evaluation circuit connected to the receiving element. The radiation sent by the sending element and reflected and/or transmitted by the textile can be received by the receiving element and evaluated in the evaluation circuit.

German Published, Non-Prosecuted Patent Application DE 37 06 056 A1 discloses a method of generating and detecting optical spectra and also a switching and sensor system that are intended for sewing and textile automation. In the case of the prior-art method, a radiation device that includes at least two, preferably three, semiconductor emitters is used. These send an optical radiation of differing wavelength, which ranges from the ultraviolet range through the visible range into the infrared range, the radiation being modulated at a specific frequency. The radiation is directed onto a common surface or a single measuring point of a medium. Subsequently, the radiation reflected or allowed through by the medium is sensed by a correspondingly adapted receiver and fed to a downstream electronic evaluation device. With the known method, it is intended to detect differences in a material or medium in the radiation spectral range from ultraviolet to infrared using automatic machines or robots in the sewing and making-up of clothing, the textile industry and general production engineering. However, the document does not indicate how a switching and sensor system of this type with a sending element and a receiving element can be used.

SUMMARY OF THE INVENTION

It is accordingly an object of the invention to provide a device for determining type and dampness of textiles, appliances applying the device, a method for detecting type and dampness of textiles, and a method for determining a filling level of a container that overcomes the hereinaforementioned disadvantages of the heretofore-known devices of this general type and treats textiles appropriately even when directions on how a textile is to be treated cannot be obtained.

With the foregoing and other objects in view, there is provided, in accordance with the invention, a device typically used in appliances such as washing machines, laundry dryers, spin dryers, machines for dry cleaning, and machines for dying textiles. The appliances include a drum. The device detects properties of textiles and includes a sending element, a receiving element, and an evaluation circuit. The sending element sends electromagnetic radiation to a textile. The receiving element receives electromagnetic radiation that is transmitted through and/or reflected from the textile. The evaluation circuit connects to the receiving element and evaluates the electromagnetic radiation received by the receiving element.

With the objects of the invention in view, there is also provided a method of detecting properties of textiles in an appliance. The first step of the method is providing a container. The next step is irradiating a textile with electromagnetic radiation from a transmitting element. The next step is receiving electromagnetic radiation from the textile with a receiving element. The next step is evaluating the electromagnetic radiation received by the receiving element with an evaluation unit.

In other words, the method provides that at least one sending element irradiates the textile with electromagnetic radiation. Then, at least one receiving element receives radiation reflected and/or transmitted by the textile. Next, an evaluation circuit evaluates this radiation.

According to the invention, electromagnetic radiation, i.e. radiation in the UV, visible or IR range, is used to determine properties of a textile. In the treating appliance, the textile is treated in some way, for example wetted with a liquid medium, dried, spun, starched, ironed, mangled, portioned, cut, dry-cleaned, and/or are changed in some other way. The treating appliance is correspondingly a laundry treating appliance: e.g. a washing machine, a laundry dryer, a spin dryer, a smoothing iron, a laundry mangle, a machine for dry cleaning, or for dying textiles. When the term "garment" is used hereafter, it is always to be understood as meaning any type of textile medium.

For the purposes of the invention, a sending element is any emitter which emits electromagnetic radiation, that is for example an incandescent lamp, a halogen lamp, a mercury-vapor lamp, a light-emitting diode, a laser diode, a gas laser, and the like. Particularly suitable are emitters that emit a narrowband spectrum, or emitters that generate monochromatic light. Suitable are monochromatic or narrowband emitters in conjunction with one or more receivers. The receivers may receive across a broadband as long as they cover the bandwidth of the radiation emitted by the emitter or emitters. Alternatively, broadband emitters and assigned wavelength-selective receivers can be used. Instead of wavelength-selective receivers, broadband emitters and/or receivers can also be used, if either the emitters or the receivers are assigned narrowband filters. Preferably, a plurality of sending elements is also used. A plurality of sending elements generates either different spectra or monochromatic light of different wavelengths. In a corresponding way, the receiving elements are adapted to the sending elements. These receiving elements sense either a certain band within the sending radiation emitted by the sending element or the sending elements. Alternatively, they can sense precisely the wavelength that the sending element or the sending elements are emitting, if the sending elements are monochromatic light sources. Consequently, suitable receiving elements include photodiodes or phototransistors. If the sending element emits radiation in a number of wavelength ranges, a plurality of receiving elements are preferably used, in particular photodiodes, with an upstream filter or grating, or a photodiode array or CCDs (=charged coupled devices), which absorb light and generate corresponding electrical signals. The electrical signals are preferably amplified and fed to the evaluation circuit. The received light must be selected according to wavelengths. This optionally takes place by a filter, a prism, or a diffraction grating.

The light emitted by the sending element or the sending elements is partly absorbed, but partly reflected or transmitted, by the textiles, in particular the garment. In this case, the reflected light is primarily suitable for the detection, because the transmitted light makes up only a small fraction of the sending radiation and the proportion of the transmitted radiation greatly decreases with increasing thickness of the textiles.

Based on the spectra or wavelengths reflected by the textiles from a spectrum sent, the properties of the textiles can be concluded. This similarly applies to the transmission spectra. In this case, the spectra are either evaluated over a specific spectral range or only in respect of specific frequencies or wave numbers. For the purposes of the invention, properties of the textiles are to be understood as meaning both permanent properties of the textiles, i.e. their chemical composition of various fibers, for example cotton, wool, silk, synthetic fibers, or their type of fabric, and temporary properties, which result from the treatment with specific media. Particularly relevant here is the wetting by water or an organic solvent, by detergent solution or the treatment by starch or some other finishing agent.

The evaluation circuit obtains from the received signals a signal that either is directly of significance for the operator or is relevant for the further treatment of textiles. For example, a signal to warn the operator against incorrectly programming the treating appliance can be obtained. When the evaluation circuit is used in a washing machine, the evaluation circuit obtains from the electromagnetic radiation received, for example in the IR range, information on the type of textile, for example silk, and produces an optical or acoustic signal if the operator sets a temperature at which silk would be damaged. In another case, the heating-up of the washing machine to a temperature above the temperature permissible for silk is automatically prevented and a program which makes allowance for the properties of the textiles loaded into the laundry drum is carried out by the evaluation circuit, so that none of the textiles are damaged, discolored, etc.

According to a special embodiment of the invention, the sensing of temporary properties of textiles, for example the dampness, is considered when providing a treatment in the washing machine or the laundry dryer that is adapted to the desired residual dampness. Consequently, if the operator has set a certain residual dampness, a respective dampness state is sensed continuously or at specific time intervals during the spinning or drying process based on the electromagnetic radiation reflected and/or transmitted by the textiles and a remaining running time of the spin dryer or of the drying program is calculated from this. When the residual dampness is achieved, the spinning or drying is discontinued.

According to the invention, the filling level or loading of a laundry-treating machine can also be sensed. This already takes place for example when machine is being loaded, if each garment is sensed by the sensor, preferably by a plurality of sensors, so that information on the surface area consumed by the textiles within the laundry drum can be determined. In the volumetric determination of the drum filling level, the reflections induced by the rear wall of the drum are considered. The evaluation circuit or an already existing control circuit then calculates from this the amount of water required for cleaning the textiles, the amount of detergent, the type of mechanical treatment and the maximum permissible temperature, taking into account the type or types of textile. Finally, the evaluation circuit decides on the duration of the laundry treatment, that is for example the washing, spinning, drying, and cleaning.

In addition, information obtained from the textiles can be combined with other information already existing in the laundry-treating machine: for example, considering the turbidity of the detergent solution, in order to determine the duration and/or the temperature of the washing process. According to one embodiment of the laundry-treating appliance, the evaluation circuit is connected to the program selection control in such a way that a specific program is selected by the laundry-treating appliance based on the detected garments in accordance with the material or the dampness of the garments. This means that, if for example a garment of silk is detected among the garments, the maximum temperature of the program is selected by the program selection control in such a way that the garment of silk does not shrink or become damaged by too high a temperature.

One advantage of the appliance is also that the device for detecting properties of a textile can also be used when the textile is not to undergo treatment but it is just intended to detect the material composition of the textile. This might be necessary when the label showing the material composition is no longer present in the textile or has been removed. The user then learns from the device in conjunction with a display unit the materials of which the textile is constructed, and can then decide which further treatment it is to be given.

Particularly for the case of an individual textile measurement of this type, but also for other detection purposes, it is suitable if the location irradiated with infrared radiation is made perceptible for the user by simultaneous emission of visible radiation. For this purpose, for example, a visible illumination annularly surrounding the location of the textile irradiated by the IR radiation is generated on the textile. Similarly, the location irradiated by infrared radiation can be made identifiable by a red dot generated by an LED.

Sending and receiving elements can be used in various positions inside or outside the treating appliance. In a laundry dryer, the receiving element or the receiving elements are advantageously disposed in the top region of the loading opening. Similarly, a sending element is disposed there. A lamp provided for illuminating the interior of the laundry drum also may be suitable as a sending element. Alternatively, sending and/or receiving elements can be used in the region above the loading opening of the rear bottom wall of the laundry drum, in particular whenever a lamp is already provided there for interior illumination of the drum. If this lamp is a halogen lamp or some other broadband emitter, it is already suitable as a sending element. In order however to eliminate undesired extraneous light effects, penetrating for example through the porthole of the rear bottom wall of the laundry drum, the light emitted by the sending element is modulated in a specific way and the reflected or emitted light is only used when it has the same modulation.

Sending and receiving elements are preferably used in conjunction with optical devices, in particular focusing lenses, optical waveguides, and also optical and/or electrical configurations for amplifying optical or electrical signals.

Filters are also advantageously used to separate narrow spectral ranges. Suitable examples of filters are diffraction gratings, which are transmissive at different angles for different wavelengths, prisms, holographic filters, gratings, and the like. Particularly suitable are also graduated filters, from which irradiated broadband light is coupled at different locations. A preferably alternative is optical waveguides. Optical wavelguides allow sending and transmitting elements to be disposed at a place inside the treating appliance that is exposed only to low mechanical loads and which couple the electromagnetic radiation into the region in which the textiles are being treated via an optical waveguide and/or pass it from this region via an optical waveguide to the receiving element.

The use of the optical waveguides has the further advantage that high temperatures, which are often used in the treatment of textiles, for example within the laundry drum of a washing machine or the dryer drum of a laundry dryer, do not influence the optical elements, such as for example the sending and receiving elements and also the optics assigned to them, so that no measures to balance or compensate temperature fluctuations at the sending and/or receiving elements are necessary. Another advantage is that low-cost sending and/or receiving elements can be used. Low-cost sending and/or receiving elements have lower requirements in terms of temperature stability and, therefore, have to be less stable with respect to the influences that are present within the drum of a laundry dryer or a washing machine and can adversely influence sending and receiving elements. The same advantage also applies to the use of control or evaluation electronics assigned to the respective sending and receiving elements.

However, the invention does not exclude the possibility of the evaluation circuits, including the sending and receiving elements, being disposed directly in the treatment region of the textiles.

Sending and receiving elements are preferably protected against soiling occurring within the treatment space of the textiles in the form of fluff and dust, in that an air stream is directed past the sending or receiving elements. Inside a laundry dryer, the circulating air of the dryer or an air stream fed in from the outside, which for example flushes the circulating air of the dryer around in a countercurrent process, are suitable for this. In this case, ambient air or dryer air cleaned by a filter is blown firstly passed the sending and receiving elements and then into the dryer drum. However, the sending and receiving elements can also be cleaned by garments being moved past them during the cleaning operation. In the case of a washing machine, guidance of the water jet filling the laundry tub can be provided in such a way that it rinses away a covering shielding the IR radiation source.

A protective glass shields the sending and/or receiving element from the treatment space. Preferably, the protective glass shields can be removed by the user for cleaning.

Preferably, an automatic adjustment between a sent signal and a received signal in the absence of textiles to be treated also takes place. The automatic adjustment subtracts errors caused by contaminants within the treatment space, i.e. in particular on a glass shielding sending and receiving elements: for example, in the subsequent measurement performed on textiles as differential signals from the signals then measured. The sending and/or receiving elements can, for example, be respectively calibrated when the appliance is switched on.

Wavelengths in the near and middle infrared ranges (NIR and MIR ranges) are particularly suitable for textile detection. Within this wavelength range, organic fabrics, i.e. textiles, undergo molecular vibrations when exposed to external energy. Depending on the type of textile, and in accordance with its chemical composition, it absorbs corresponding spectral components from an electromagnetic radiation with which it is irradiated, or reflects them, and/or transmits them. The energy is preferably coupled into the textiles with a broadband emitter, for example an incandescent lamp, a halogen lamp, or a light-emitting diode, but other, narrowband emitters are also suitable. The textiles and the water contained therein absorb energy from the electromagnetic radiation over the entire irradiated spectral range of the light source. The light not absorbed is reflected and/or transmitted, part of this light is passed to the evaluation circuit by the receiving element or elements. If the received radiation represents a spectrum, a spectral breakdown of the spectrum received is preferably conducted there. Particularly suitable is the Fourier transformation of the spectra (FTIR). This breakdown can be performed according to the following principles. The electromagnetic signals are irradiated by a filter or by a plurality of filters onto the receiving elements. The receiving elements can be formed by individual receiving diodes, individual phototransistors, or by receiving elements configured in the form of a CCD array. Instead of the filters disposed ahead of the receiving elements, diffraction gratings can also be provided.

A coupling-in optical system, which apart from a grating or a filter, also includes a lens system. Preferably, the lens system is a converging lens.

The selection of which spectral ranges are actually used or blocked by the receiving elements depends on the object to be detected. If it is accordingly known which types of textiles come into consideration at all for the treating appliance, it is possible to provide correspondingly narrowband receiving elements, which specifically absorb wavelength ranges relevant in respect of these textiles, in order in this way to allow an analysis of the chemical composition or the instantaneous state of the textile. In this case, it is also possible to determine specific types of soiling of a textile: for example, proteinaceous or greasy soiling. The same also applies correspondingly to the evaluation circuit. It is similarly possible to extend the spectroscopic investigation of the textiles into the visible range, in order also to be able to determine the color of the textiles.

Because the moisture content of a textile also has an influence on its absorption and/or transmission spectrum in a specific wavelength range. Preferably, those wavelength ranges in which either a dependency of this type does not exist or it at least has no perceptible influence on the distinguishability between various types of textiles are preferably selected for the measurement of the dampness on the one hand and the type of textile on the other hand.

Alternatively, information which takes into account the dependence of the spectrum of a textile on the moisture taken up is also stored in a memory unit assigned to the evaluation circuit, in order to correct spectral measurements in a way corresponding to the desired data, whether concerning the type of the textile or concerning the moisture content.

Various properties of the spectra are suitable in the evaluation of the spectra, for example their slope, the height of peaks, the relative height of various peaks, derivative functions from the spectra, and variables obtained from the spectra. A factor analysis of the spectra is preferably also conducted. All the data thereby obtained can be stored in a memory unit and are then available for comparison with later measurement results.

In a particularly preferred embodiment of the invention, the evaluation unit includes a fuzzy logic or a neural network, in which various properties for the detection of permanent properties of textiles can be detected. Examples of the properties to be detected include chemical composition, temporary properties of textiles such as moisture content, temperature, or wetting by a liquid. Spectra for various types of textiles, in particular for various degrees of dampness of these textiles, are preferably available in the memory unit or are successively stored during the operation of the treating appliance and are respectively taken into account during the treatment or processing of textiles.

The drum filling level of a washing machine or a laundry dryer can also be determined by the device for detecting the properties of textiles, in that the intensity of the reflected light is ascertained. This utilizes the fact that textiles scatter the light less than the laundry drum, which is built from high-grade steel. In principle, the difference between the materials of the laundry drum and garments can be utilized to sense the volume filled with laundry within the laundry-treating appliance. This is preferably involves performing an integral measurement of the spectra.

The device is likewise suitable for detecting when the drum is at a standstill because the measured spectra do not change over time in this case. Tearing of the drive belt may cause such a standstill of the drum.

In the case of smoke being produced within the laundry drum, the spectrometer can also be used in conjunction with the evaluation circuit as a smoke detector. When a certain density of smoke is reached, the spectra of the garments can no longer be detected. The evaluation circuit then generates a signal triggering a fire alarm at a receiver, for example at a fire station, if the domestic appliance is connected to a data network. Alternatively, an acoustic fire alarm is connected to the laundry-treating appliance or is provided in the home.

Other features that are considered as characteristic for the invention are set forth in the appended claims.

Although the invention is illustrated and described herein as embodied in a device for determining type and dampness of textiles, appliances applying the device, a method for detecting type and dampness of textiles, and a method for determining a filling level of a container, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
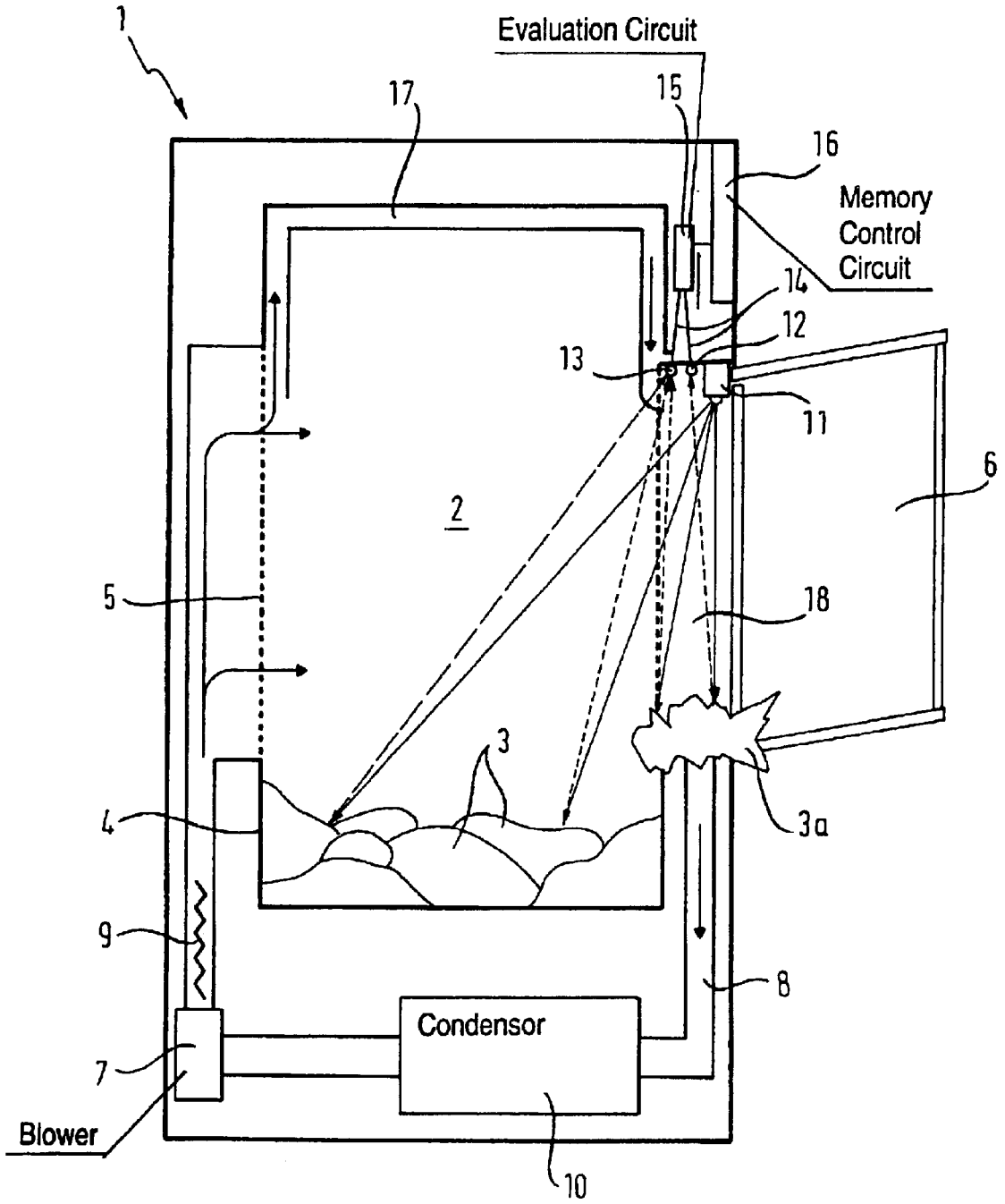
FIG. 1 is a partial diagrammatic and partial schematic sectional view of a laundry dryer according to the invention.
Figure 2:
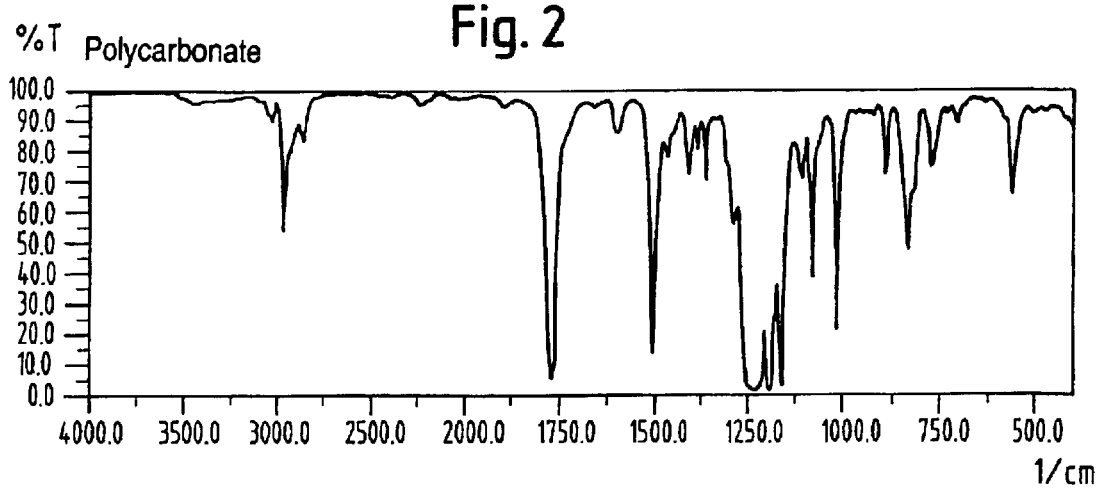
FIG. 2 is a spectrum plotting transmittance versus wavelength for polycarbonate.
Figure 3:
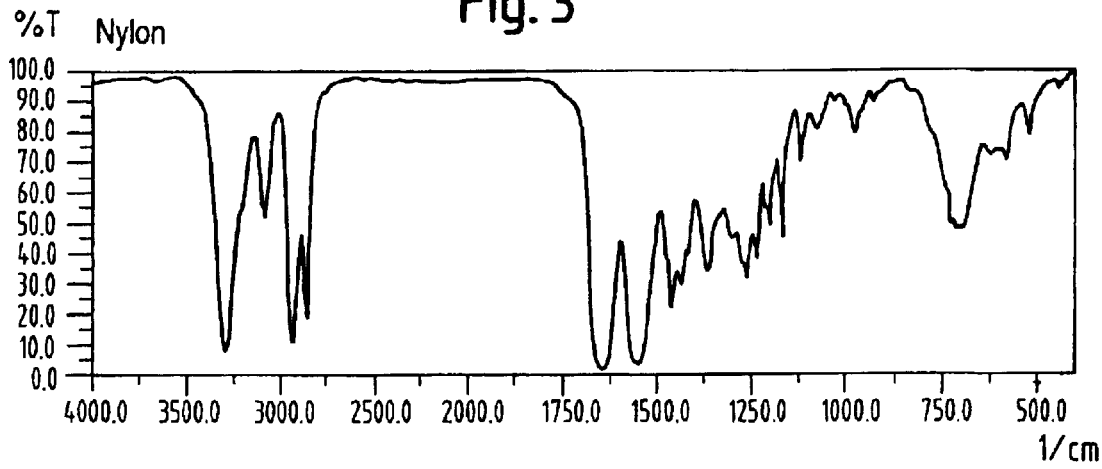
FIG. 3 is a spectrum plotting transmittance versus wavelength for nylon.
Figure 4:
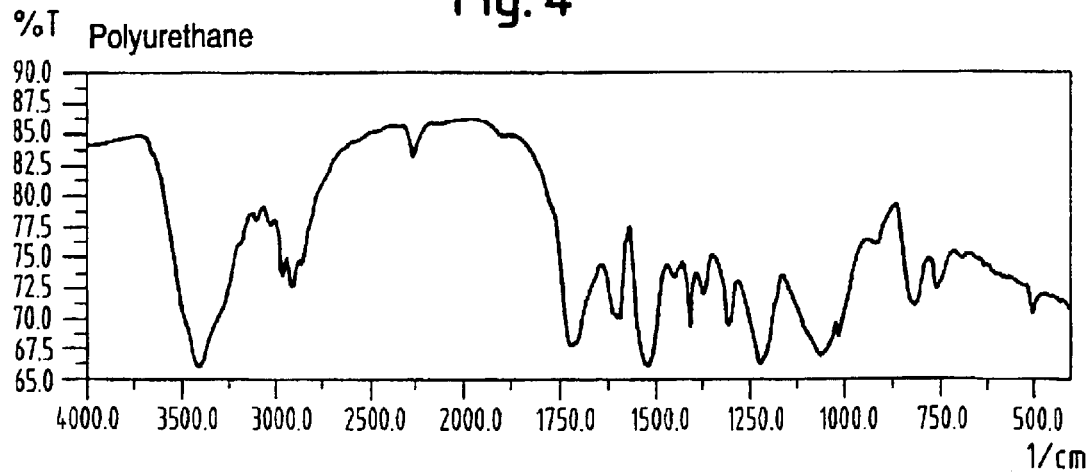
FIG. 4 is a spectrum plotting transmittance versus wavelength for polyurethane.
Figure 5:
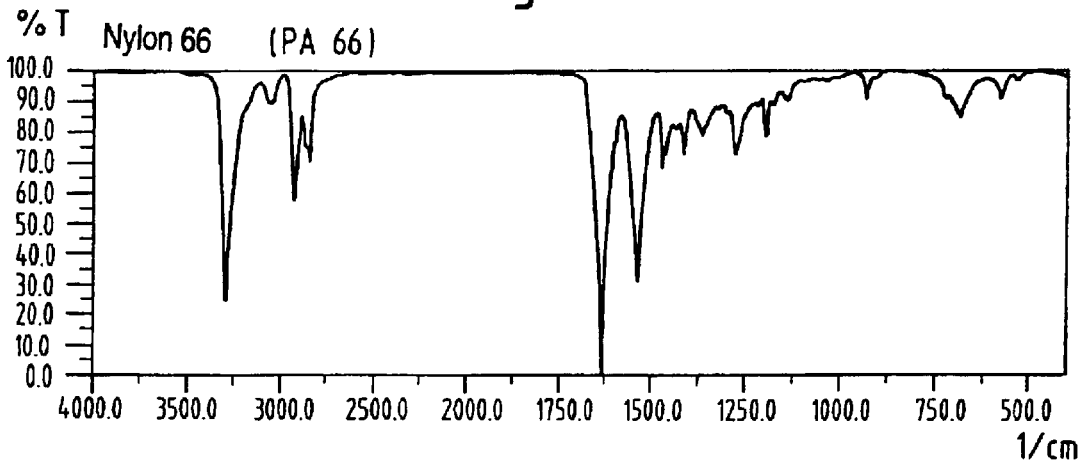
FIG. 5 is a spectrum plotting transmittance versus wavelength for nylon 66.

Referring now to the figures of the drawings in detail and first, particularly to FIG. 1 thereof, there is shown a laundry dryer 1. The laundry dryer 1 is equipped with a rotatably mounted drum 2 for receiving laundry 3 to be dried. The drum 2 has a drum base 4 and is perforated in its central region 5. The perforation serves for the filtering of a drying air stream. On the side lying opposite the drum base 4, a loading door 6 can close an opening. During operation, the drying air stream is generated by a blower 7, flows through a circulating air circuit 8 to a heating device 9 for the heating of the drying air, and passes through the middle region 5 of the drum base 4 into the drum 2.

After contact with the laundry 3, the drying air flows through the loading door 6, which has openings on the inner side and the underside, through a further portion of the circulating air circuit 8 to a condenser, in which the drying air is cooled to condense garment moisture contained in it. For this purpose, the condenser 10 is flowed through by cooling air, which is sucked in from the ambience of the laundry dryer 1. After the condenser 10, the drying air is sucked in again by the blower. In the region of the loading opening, a lamp 11 is provided, for example a broadband emitter, in particular an incandescent bulb, a halogen lamp, or a light-emitting diode. This emits electromagnetic radiation onto the laundry 3 to be dried within the drum 2. In a way corresponding to the type of textile and the dampness of the laundry 3, part of the radiation is reflected, a certain part of the reflected radiation reaching receiving elements 12, 13. The receiving elements 12, 13 are sensitive in different spectral ranges, such as for example in the case of a silicon diode in a bandwidth of less than 1100 nm or in the case of an InGaAs diode in a bandwidth of from 800 nm to 1700 nm. Placing a filter on the beam entry side of the receiving elements 12, 13 allows the effect to be achieved that only a specific narrowband or only a specific wavelength can be received by the respective receiving element 12, 13. In this case, the wavelength ranges in which the receiving elements 12, 13 are sensitive can be selected in such a way that, for example, the receiving element 12 is sensitive in a wavelength range of from 800 to 1700 nm and detects different types of textiles: for example, cotton, linen, silk, viscose, wool, nylon, or other textile materials.

FIGS. 2 to 5 show transmission spectra of polycarbonate, nylon 6, polyurethane, and nylon 66 in the wave number range of from 4000 to 500 $cm^{-1}$. The spectra as a function of the wave number respectively show characteristic peaks, slopes and minima, which are material-specific and allow fabrics that contain materials of this type to be distinguished from other fabrics.

In an evaluation circuit 15 (see FIG. 1), further functions can also be ascertained from the received spectra, for example the derivative function dA/dk (A=absorption, k=wave number) or higher derivatives. These allow extreme values, slopes, inflection points, etc. of the spectra to be obtained.

Figure 6:
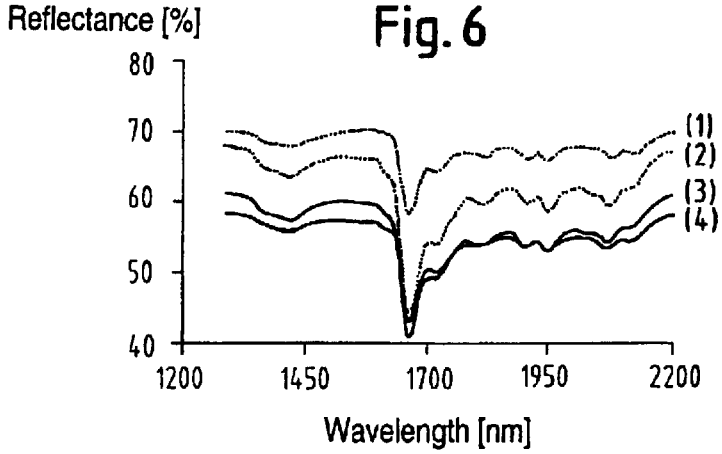
FIG. 6 is a spectrum plotting reflectance versus wavelength.
Figure 7:
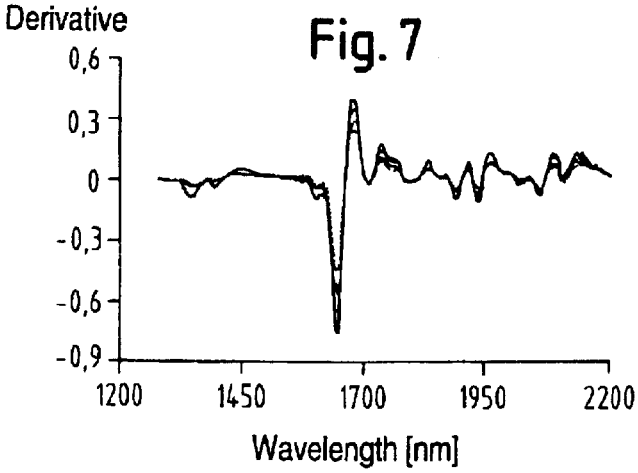
FIG. 7 is a spectrum plotting derivative of reflectance versus wavelength.

FIG. 6 shows the reflectance spectrum of four polyester garments that originate from different fabrics. Different scattering of the light produces reflectance spectra displaced substantially parallel to one another. In derivative functions obtained from the spectra (FIG. 7), the match in the material is again evident.

Figure 8:
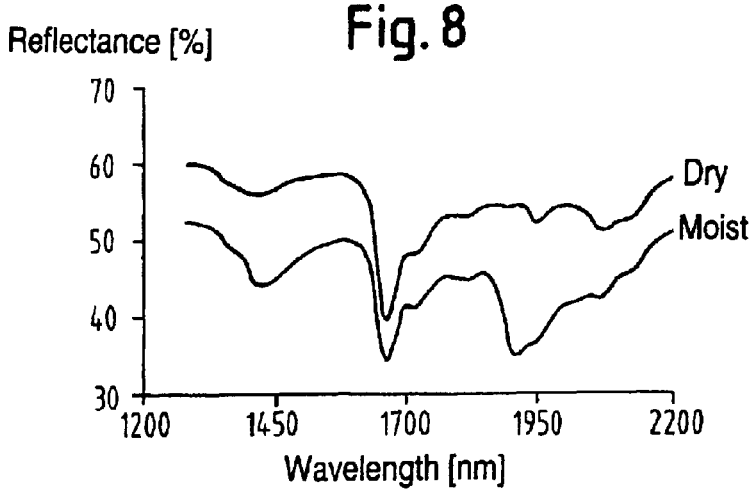
FIG. 8 is a spectrum plotting reflectance versus wavelength.
Figure 9:
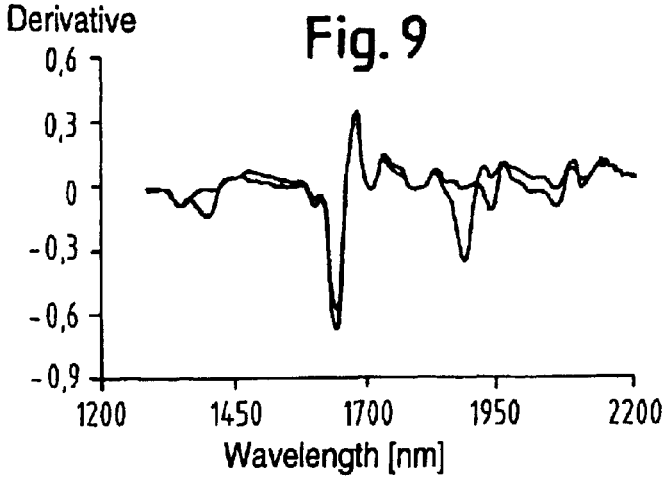
FIG. 9 is a spectrum plotting derivative of reflectance versus wavelength.

FIG. 8 shows reflection spectra of a moist and a dry polyester fabric, which also show differences in their derivative functions (FIG. 9).

Different materials can be separated from one another by spectroscopy in the near infrared range with a main component analysis, as known for example from the book "Erkennen von Kunststoffen—Qualitative Kunststoffanalyse mit einfachen Mitteln" [Detecting Synthetic Materials—Qualitative Synthetic Material Analysis By Simple Means], by Dietrich Braun, 1998, 3$^{rd}$ edition. This shows that the wavelength range from 1500 nm to 1800 nm is moisture-independent.

Figure 10:
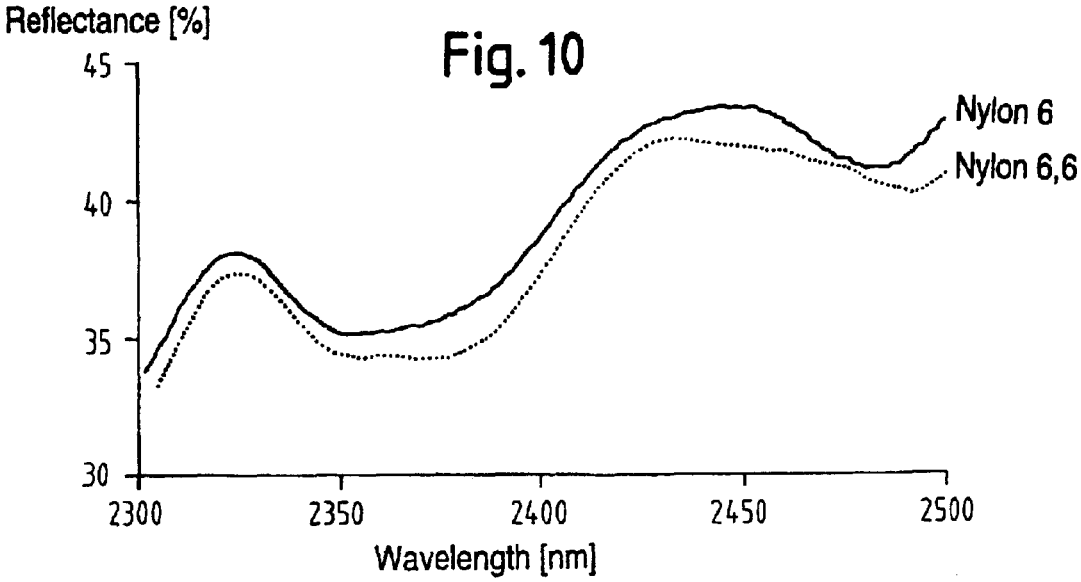
FIG. 10 is a spectrum plotting reflectance versus wavelength.

FIG. 10 shows reflectance or reflection spectra of nylon 6 and nylon 6,6, which can only be separated from one another in a wavelength range of between 2400 and 2500 nm.

Figure 11:
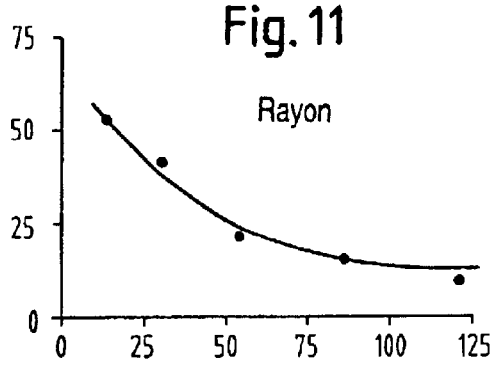
FIG. 11 is a spectrum plotting reflectance versus wavelength for rayon.
Figure 12:
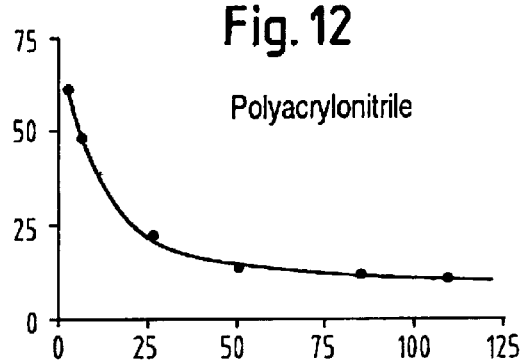
FIG. 12 is a spectrum plotting reflectance versus wavelength for polyacrylonitrile.

FIGS. 11 and 12 show reflection spectra of rayon and polyacrylonitrile at a reflection of the water band, which depends on the moisture content of the fibers. The moisture content can be determined by the evaluation circuit 15.

Figure 13:
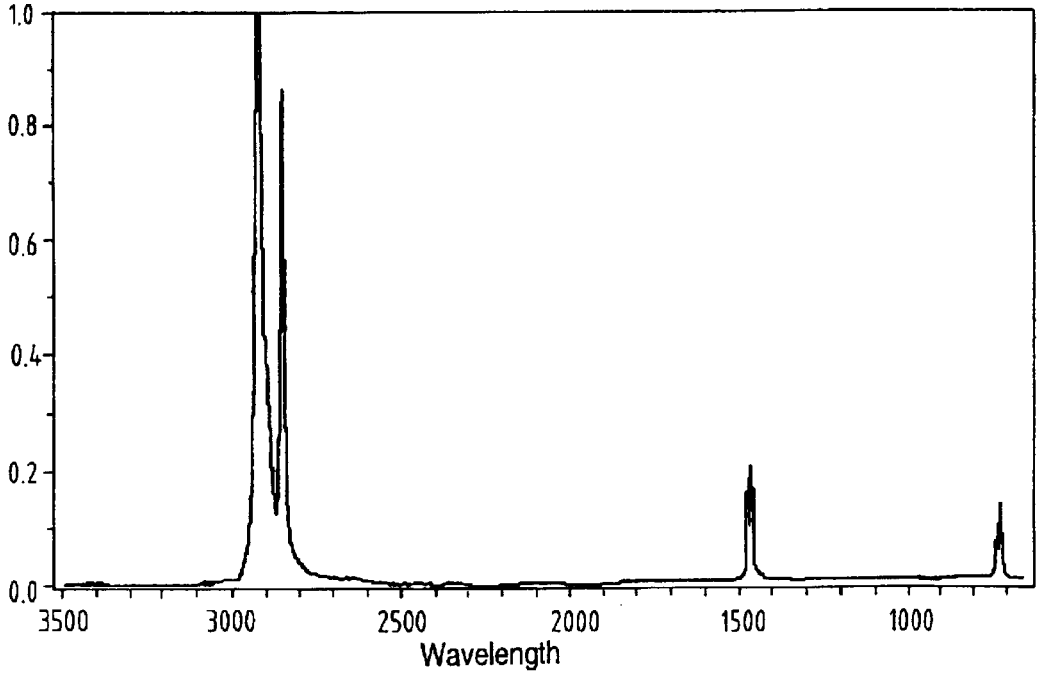
FIG. 13 is a spectrum plotting absorption versus wavelength.

FIG. 13 shows an absorption spectrum of polyethylene in the wave number range of from 3500 to 500 $cm^{-1}$.

Figure 14:
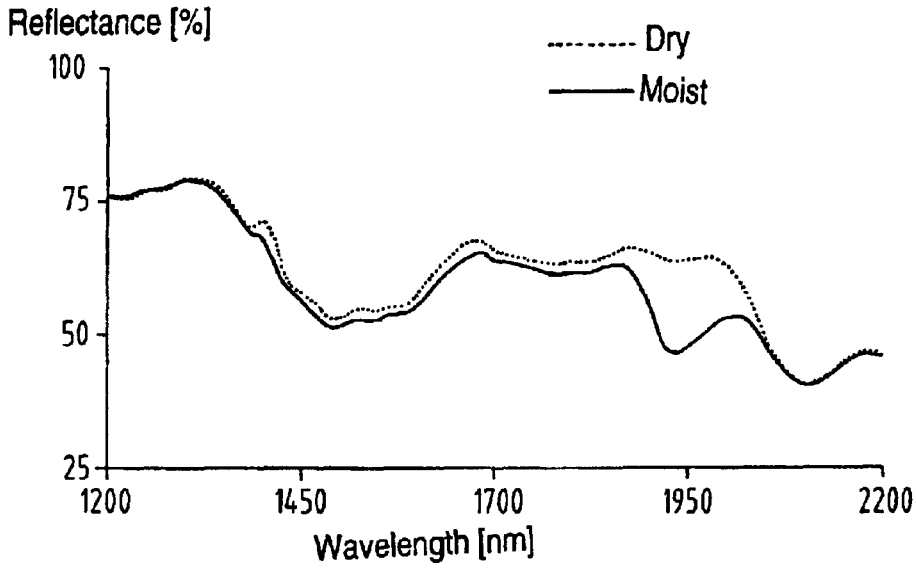
FIG. 14 is a spectrum plotting reflectance versus wavelength.

FIG. 14 shows a reflection spectrum of cotton in the dry and moist states, the cotton still having a certain residual dampness when it is in the garment dryer 1. If the spectra for dry cotton is consequently stored in a memory assigned to the evaluation circuit 15, it can be detected from the respectively measured spectrum, by comparison with the spectrum for dry cotton, whether the drying process must be continued or whether the desired residual dampness, for example the ironing dampness or closet dampness, has already been reached.

Figure 15:
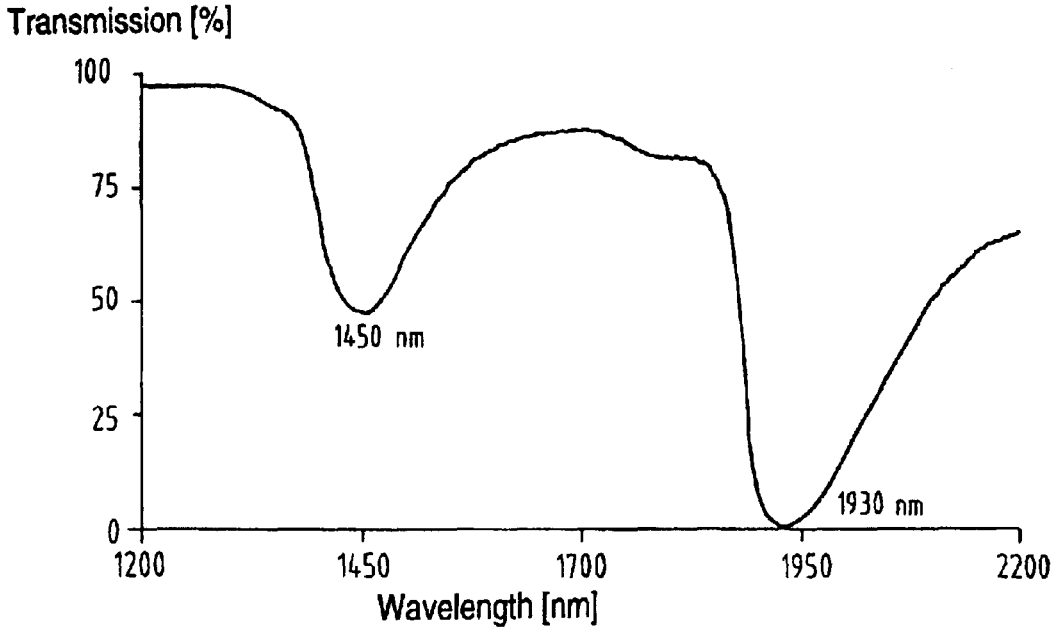
FIG. 15 is a spectrum plotting transmission versus wavelength.

FIG. 15 represents a transmission spectrum for water, which has two characteristic minima at 1450 nm and 1930 nm. This measurement can be conducted with a receiving element that is disposed underneath the laundry that has been introduced into the drum 2 or on the lower side of the loading opening so that the element receives the radiation allowed through the laundry 3 when the sending element 11 emits electromagnetic radiation.

Instead of the transmission spectrum, measurements of the reflection spectrum of water can also be carried out by one of the receiving elements 12, 13 in this wavelength range.

The receiving elements 12, 13 are connected to the evaluation circuit 15 via lines 14. The evaluation circuit 15 contains evaluation electronics. Based on the electronics, the spectra of the textiles or especially relevant parts in the spectra can be detected. The evaluation circuit 15 is also preferably assigned a memory, in which known spectra are stored, so that the evaluation unit 15 can reliably detect a type of textile by comparison of the received spectra with the stored spectra.

The evaluation unit is preferably equipped with a system that is capable of learning, using fuzzy logic, or applying a neural network. If the evaluation circuit 15 is a self-learning system, it can be trained in such a way that it later recognizes spectra. The evaluation circuit 15 is in connection with a control circuit 16 for controlling the garment dryer 1. In particular, it also has access to the memory of the control circuit 16, to compare and evaluate spectra.

When the evaluation circuit 15 detects a spectrum in a specific program state, it can influence the further program sequence. If a reached residual dampness is detected by one of the receiving elements 12, 13 and, after detection by the evaluation circuit 15, the latter sends a corresponding signal to the control circuit 16. Then, the control circuit 16 continues the drying operation until the desired residual dampness set by the operator is reached. It is similarly possible for the evaluation device 15 to trigger an alarm signal or end the respectively running program when a specific operating state is reached. In this way, it is possible to prevent textiles from being excessively treated or damaged. This is of significance in particular if the operator has introduced textiles of different compositions into the drum 2 without noticing, so that in this case the program can be discontinued in order that even the most sensitive of the textiles introduced is not damaged. The receiving elements 12, 13 either are individual diodes or are a combination of arrays including many diodes or phototransistors or similar receivers. Disposed ahead of the receiving elements 12 and 13 is a coupling-in optical system. The optical system can include a focusing lens, a diffraction grating, and/or an optical waveguide. Electromagnetic beams from a flexible optical waveguide can also be sensed at the places that are unsuitable for attaching the receiving elements 12, 13. The spectra of the textiles are either punctiform, or the measuring signals are spatially integrated.

To ensure good coupling of the light to the receiving elements 12, 13 at all times during the operation of the laundry dryer 1 and also satisfactory emission of light from the sending element 11, part of the air stream is deflected via a flow duct 17 separately provided for this purpose. The air stream in the duct brushes past the receiving elements 12, 13 and the sending element 11 and keeps them free from soiling. Alternatively, air from the outside can also be used for cleaning, and similarly the circulating air can be used, in particular in a countercurrent process. In this case, after passing a filter, the cleaned ambient air or circulating air of the dryer is blown into the drum 2 from the direction of the receiving elements 12, 13 and the sending element 11.

According to the invention, this provides a method of detecting properties of a textile which can be used in various treating appliances, for example in washing machines, laundry dryers, spin dryers, or machines for dry cleaning with a non-aqueous solvent. In each case, the type of textile can be checked, and it can be checked whether the program selection set by the user coincides, and is compatible, with the type of textile introduced. If there is imminent damage to the textiles, the appliance produces a warning—optically or acoustically—, or the treating appliance automatically carries out a program correction. It is similarly possible for the treating appliance automatically to select and carry out the program adapted to the textiles concerned. This reliably allows overheating and consequent damage to a textile to be avoided, for example in a spin dryer or in a washing machine. The dampness determination in the case of a washing machine is included in the remaining duration of the spinning operation, in the case of a laundry dryer 1 it is included in the remaining duration of the drying operation.

The invention provides for a contactless measurement to be conducted with electromagnetic radiation, allowing conclusions to be drawn concerning various properties of the textiles, such as their dampness, chemical composition, etc. In the case of a laundry dryer, the entire dryer content of the laundry 3 to be dried can be sensed either in the loaded state or when a garment 3*a* is being loaded, while the loading door 6 is open.

The sensing of the properties of the garments 3, 3*a* by the evaluation circuit 15, in particular in conjunction with the control circuit 16, allows the drying process in the laundry dryer 1 to be optimized with regard to the drying power used and the drying duration, or in a washing machine the washing process. Energy, water consumption, the type and amount of detergent and the type of mechanical treatment and also the duration of treatment are ascertained by an evaluation circuit or control circuit in the washing machine automatically or in conjunction with presettings of a operator, taking the measured spectra into account.

We claim:

1. In combination with an appliance having a drum for holding textiles, a device for detecting properties of the textiles, the device comprising:

a sending element for sending electromagnetic radiation to a textile item;

a receiving element for receiving electromagnetic radiation from the textile item; and an evaluation circuit connected to said receiving element and evaluating the electromagnetic radiation received by said receiving element.

2. The device according to claim 1, wherein said receiving element receives electromagnetic radiation reflected by the textile item.

3. The device according to claim 1, wherein said receiving element receives electromagnetic radiation transmitted through the textile item.

4. The device according to claim 1, wherein:

the drum holds the textile item;

said sending element irradiates electromagnetic radiation into the drum to the textile item; and said receiving element receives electromagnetic radiation from the textile item loaded in the drum.

5. The device according to claim 4, wherein said sending element and said receiving element are disposed in the drum.

6. The device according to claim 5, wherein:

the drum has a loading opening; and at least one of said sending element and said receiving element are disposed by the loading opening.

7. The device according to claim 6, wherein:

the drum has an upper side; and at least one of said sending element and said receiving element are disposed by the upper side.

8. The device according to claim 5, wherein:

the drum has a base; and at least one of said sending element and said receiving element is attached to the base of the drum.

9. The device according to claim 5, wherein:

the drum has a loading door with an inner side; and at least one of said sending element and said receiving element is on the loading door.

10. The device according to claim 1, wherein said sending element is a broadband emitter.

11. The device according to claim 10, wherein said broadband emitter is selected from the group consisting of an incandescent bulb, a halogen lamp, and a light-emitting diode.

12. The device according to claim 1, wherein said receiving element is a narrowband receiver.

13. The device according to claim 12, wherein said narrowband receiver is selected from the group consisting of a photodiode and a phototransistor.

14. The device according to claim 1, wherein said receiving element is formed as an array including a plurality of receiving components.

15. The device according to claim 6, wherein the at least one of said sending element and said receiving element disposed by the loading opening is formed with an optical component.

16. The device according to claim 15, wherein said optical component is a focusing lens coupling the electromagnetic radiation in and out.

17. The device according claim 6, wherein said receiving element breaks down spectrally the received electromagnetic radiation with a filter selected from the group consisting of an optical filter, a graduated filter, a diffraction grating, and a prism.

18. The device according to claim 6, wherein at least one of said sending element and said receiving element is equipped with an optical waveguide for coupling up or coupling in the electromagnetic radiation.

19. The device according to claim 1, further comprising a control circuit connected to said evaluation circuit.

20. The device according to claim 19, further comprising a memory for storing calibration data connected to at least one of said evaluation circuit and said control circuit.

21. The device according to claim 20, wherein the calibration data is selected from the group consisting of predetermined spectra and measured spectra.

22. The device according to claim 1, wherein at least one of said sending element and said receiving element is equipped with a soiling protector.

23. The device according to claim 22, wherein said soiling protector is formed by an air stream.

24. The device according to claim 23, further comprising a flow duct connected to the drum; and said air stream is circulating air fed from said flow duct.

25. The device according to claim 23, wherein said air stream is air sucked from outside the drum.

26. The device according to claim 19, wherein at least one of said evaluation circuit and said control circuit utilize artificial intelligence selected from the group consisting of fuzzy logic and a neural network.

27. The device according to claim 1, wherein said receiving element is an array including a plurality of receiving components.

28. A washing machine for washing textiles according to detected properties of the textiles, the washing machine comprising:

a drum; and a device connected to said drum for detecting properties of a textile item including a sending element for sending electromagnetic radiation to the textile item, a receiving element for receiving electromagnetic radiation from the textile item, and an evaluation circuit connected to said receiving element and evaluating the electromagnetic radiation received by said receiving element.

29. A laundry dryer for drying textiles according to detected properties of the textiles, the laundry dryer comprising:

a drum; and a device connected to said drum for detecting properties of a textile item including a sending element for sending electromagnetic radiation to the textile item, a receiving element for receiving electromagnetic radiation from the textile item, and an evaluation circuit connected to said receiving element and evaluating the electromagnetic radiation received by said receiving element.

30. A spin dryer for drying textiles according to detected properties of the textiles, the spin dryer comprising:

a drum; and a device connected to said drum for detecting properties of a textile item including a sending element for sending electromagnetic radiation to the textile item, a receiving element for receiving electromagnetic radiation from the textile item, and an evaluation circuit connected to said receiving element and evaluating the electromagnetic radiation received by said receiving element.

31. A machine for dry cleaning textiles according to detected properties of the textiles, the machine comprising:

a drum; and a device connected to said drum for detecting properties of a textile item including a sending element for sending electromagnetic radiation to the textile item, a receiving element for receiving electromagnetic radiation from the textile item, and an evaluation circuit connected to said receiving element and evaluating the electromagnetic radiation received by said receiving element.

32. A machine for dying textiles for drying textiles according to detected properties of the textiles, the machine comprising:

a drum; and a device connected to said drum for detecting properties of a textile item including a sending element sending electromagnetic radiation to the textile item, a receiving element for receiving electromagnetic radiation from the textile item, and an evaluation circuit connected to said receiving element and evaluating the electromagnetic radiation received by said receiving element.

33. A method of detecting properties of textiles in an appliance, which comprises:

providing a container;

irradiating a textile item with electromagnetic radiation from a transmitting element;

receiving electromagnetic radiation from the textile item with a receiving element; and evaluating the electromagnetic radiation received by the receiving element with an evaluation circuit.

34. The method according to claim 33, which further comprises selecting the appliance from the group consisting of a washing machine, a laundry dryer, a spin dryer, and a machine for dry cleaning, and a machine for dying textiles.

35. The method according to claim 33, wherein the receiving step further comprises receiving reflected electromagnetic radiation from the textile item.

36. The method according to claim 33, wherein the receiving step further comprises receiving transmitted electromagnetic radiation from the textile item.

37. The method according to claim 33, which further comprises determining chemical properties of the textile item from the received electromagnetic radiation.

38. The method according to claim 33, which further comprises determining wetness of the textile item from the received electromagnetic radiation.

39. The method according to claim 33, which further comprises determining a fill level of the drum by evaluating the radiation received by the receiving element.

40. A method of detecting properties of textiles in a washing machine, which comprises:

providing a container;

irradiating a textile item with electromagnetic radiation from a transmitting element;

receiving electromagnetic radiation from the textile item with a receiving element; and evaluating the electromagnetic radiation received by the receiving element with at least one of an evaluation circuit and a control unit to determine properties of the textile item; and determining washing properties with at least one of the evaluation circuit and the control unit based upon the determined properties of the textile item, energy consumption, water consumption, type of detergent, amount of detergent, type of mechanical treatment, and duration of treatment.

41. A method of detecting properties of textiles in a laundry dryer, which comprises:

providing a container;

irradiating a textile item with electromagnetic radiation from a transmitting element;

receiving electromagnetic radiation from the textile item with a receiving element; and evaluating the electromagnetic radiation received by the receiving element with at least one of an evaluation circuit and a control unit to determine properties of the textile item; and determining drying properties with at least one of the evaluation circuit and the control unit based upon the determined properties of the textile item, drying power used, and drying duration or the washing process in a washing machine is ascertained with regard to energy consumption, water consumption, the type and amount of detergent and the type of mechanical treatment and also the duration of treatment.

42. In combination with an appliance having a loading door with an inner side and a drum for holding textiles, the drum having a loading opening, an upper side, and a base, a device for detecting properties of the textiles, the device comprising:

a transmitting element for transmitting electromagnetic radiation to a textile item;

a receiving element for receiving electromagnetic radiation from the textile item; and an evaluation circuit connected to said receiving element and evaluating the electromagnetic radiation received by said receiving element, at least one of said transmitting element and said receiving element being disposed by one of the group consisting of:

a region of the loading opening;

the upper side of the loading opening;

the base of the drum; and the inner side of the door.

43. The device according to claim 42, wherein said receiving element receives electromagnetic radiation reflected by the textile item.

44. The device according to claim 42, wherein said receiving element receives electromagnetic radiation transmitted through the textile item.

45. The device according to claim 42, wherein:

the drum holds the textile item therein;

said transmitting element irradiates electromagnetic radiation into the drum to the textile item; and said receiving element receives electromagnetic radiation from the textile item loaded in the drum.

46. The device according to claim 42, wherein said transmitting element is a broadband emitter.

47. The device according to claim 46, wherein said broadband emitter is selected from the group consisting of a light bulb, a halogen lamp, and a light-emitting diode.

48. The device according to claim 42, wherein said receiving element is a narrowband receiver.

49. The device according to claim 48, wherein said narrowband receiver is selected from the group consisting of a photodiode and a phototransistor.

50. The device according to claim 42, wherein at least one of said transmitting element and said receiving element has an optical component.

51. The device according to claim 50, wherein said optical component is a focusing lens coupling electromagnetic radiation.

52. The device according to claim 51, wherein:

said transmitting element has a focusing lens coupling out electromagnetic radiation; and said receiving element has a focusing lens coupling in electromagnetic radiation.

53. The device according claim 42, wherein said receiving element has a filter selected from the group consisting of an optical filter, a graduated filter, a diffraction grating, and a prism for spectrally resolving the received electromagnetic radiation.

54. The device according to claim 42, wherein at least one of said transmitting element and said receiving element has an optical waveguide at least one of coupling and feeding in the electromagnetic radiation.

55. The device according to claim 42, further comprising a control circuit connected to said evaluation circuit.

56. The device according to claim 55, further comprising a memory for storing calibration data connected to at least one of said evaluation circuit and said control circuit.

57. The device according to claim 56, wherein the calibration data is selected from the group consisting of predetermined spectra and measured spectra.

58. The device according to claim 42, wherein at least one of said transmitting element and said receiving element has a soiling protector.

59. The device according to claim 58, wherein said soiling protector is formed by an air stream.

60. The device according to claim 59, further comprising a flow duct connected to the drum, said air stream being circulating air fed from said flow duct.

61. The device according to claim 59, wherein said air stream is air drawn in from outside the drum.

62. The device according to claim 55, wherein at least one of said evaluation circuit and said control circuit utilize artificial intelligence selected from the group consisting of fuzzy logic and a neural network.

63. A method of detecting properties of textiles in an appliance, which comprises:

providing a container;

irradiating a textile item with electromagnetic radiation from at least one transmitting element;

receiving electromagnetic radiation at least one of reflected and transmitted by the textile item with at least one receiving element;

evaluating the electromagnetic radiation received by the receiving element with an evaluation circuit; and obtaining, with the evaluation circuit, characteristics of the textile with respect to a degree of wetting by a liquid dependent upon the evaluated electromagnetic radiation received.

64. The method according to claim 63, which further comprises selecting the appliance from the group consisting of a washing machine, a laundry dryer, a spin dryer, a machine for dry cleaning, and a machine for dying textiles.

65. The method according to claim 63, which further comprises determining, with the evaluation circuit, a chemical composition of the textile item from the received electromagnetic radiation.

66. The method according to claim 63, which further comprises:

carrying out the evaluating step by evaluating the electromagnetic radiation received by the receiving element with at least one of an evaluation circuit and a control unit to determine properties of the textile item; and dependent upon the detected characteristics of the textile item, determining with at least one of the evaluation circuit and the control unit at least one of:

washing properties selected from at least one of the group consisting of energy consumption, water consumption, type of detergent, amount of detergent, type of mechanical treatment, and duration of treatment; and drying properties selected from at least one of the group consisting of drying power used and drying duration.

67. The method according to claim 63, which further comprises determining, with the evaluation circuit, a fill level of the drum by evaluating electromagnetic radiation at least one of reflected and transmitted by the textile item.

68. A method of determining a degree of filling in a laundry drum of a laundry treatment apparatus, which comprises:

irradiating an interior space of the drum containing at least one textile item with electromagnetic radiation from at least one transmitting element;

receiving electromagnetic radiation at least one of reflected from and transmitted by the textile with at least one receiving element; and determine a degree of filling of the drum with the evaluation circuit by:

determining a first property with respect to an amount and a proportion of electromagnetic radiation at least one of reflected and absorbed by walls of the drum;

determining a second property with respect to a degree of electromagnetic radiation at least one of reflected and transmitted by the textile item; and comparing the first and second properties to ascertain the degree of filling of the drum.

* * * * *